US010422492B2

(12) United States Patent
Xiang et al.

(10) Patent No.: US 10,422,492 B2
(45) Date of Patent: Sep. 24, 2019

(54) SOLID STATE WALLPACK LIGHTING FIXTURE

(71) Applicant: MaxLite, Inc., West Caldwell, NJ (US)

(72) Inventors: Jun Xiang, Parsippany, NJ (US); Amro El-Adle, Granby, MA (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

(21) Appl. No.: 15/658,547

(22) Filed: Jul. 25, 2017

(65) Prior Publication Data

US 2018/0031191 A1 Feb. 1, 2018

Related U.S. Application Data

(60) Provisional application No. 62/369,573, filed on Aug. 1, 2016.

(51) Int. Cl.

| | |
|---|---|
| ***F21S 8/00*** | (2006.01) |
| ***F21V 3/00*** | (2015.01) |
| ***F21V 17/00*** | (2006.01) |
| ***F21V 23/06*** | (2006.01) |
| ***F21V 23/00*** | (2015.01) |
| ***F21V 31/00*** | (2006.01) |
| ***F21V 15/01*** | (2006.01) |
| *F21S 9/02* | (2006.01) |
| *F21V 27/02* | (2006.01) |
| *F21Y 113/00* | (2016.01) |
| *F21Y 115/10* | (2016.01) |
| *F21Y 115/15* | (2016.01) |

(52) U.S. Cl.

CPC ..... *F21S 8/033* (2013.01); *F21V 3/00* (2013.01); *F21V 15/01* (2013.01); *F21V 17/002* (2013.01); *F21V 23/003* (2013.01); *F21V 23/06* (2013.01); *F21V 31/00* (2013.01); *F21S 9/02* (2013.01); *F21V 27/02* (2013.01); *F21Y 2113/00* (2013.01); *F21Y 2115/10* (2016.08); *F21Y 2115/15* (2016.08)

(58) Field of Classification Search

CPC .... F21S 8/033; F21S 9/02; F21V 3/00; F21V 17/002; F21V 17/107; F21V 23/003; F21V 23/06; F21V 31/00

See application file for complete search history.

(56) References Cited

U.S. PATENT DOCUMENTS 5,379,201 A * 1/1995 Friedman ..... F21V 33/0052 362/191

7,784,205 B1 * 8/2010 Baron ..... G09F 13/04 40/552

(Continued)

*Primary Examiner* — Y M. Lee

(74) *Attorney, Agent, or Firm* — Budzyn IP Law, LLC

(57) ABSTRACT

In a first aspect, a wallpack lighting fixture is provided herein for use with solid state lighting and which is configurable to selectively utilize different quantities, up to a maximum, of solid state lighting modules, allowing for different levels and patterns of light output. In a second aspect, a wallpack lighting fixture is provided herein for use with solid state lighting which includes a main housing and a secondary enclosure removably mountable to the main housing. In a further aspect, a wallpack lighting fixture is provided herein for use with solid state lighting which includes a housing having a wall mountable back panel and a door portion hingeably, and detachably, connected to the back panel.

5 Claims, 8 Drawing Sheets

(56) References Cited

U.S. PATENT DOCUMENTS

| | | | | |
|---|---|---|---|---|
| D653,377 | S | 1/2012 | Guercio | |
| D691,320 | S | 10/2013 | Guercio et al. | |
| 8,777,460 | B2 * | 7/2014 | Newton | B23P 11/00 362/368 |
| D747,533 | S | 1/2016 | Bryant | |
| 9,951,913 | B2 * | 4/2018 | Skergeth et al. | F21S 2/005 |
| 2004/0004850 | A1 * | 1/2004 | Frank | H02M 7/003 363/59 |
| 2017/0030538 | A1 * | 2/2017 | Geisler et al. | F21S 8/083 |

* cited by examiner

SOLID STATE WALLPACK LIGHTING FIXTURE

CROSS-REFERENCE TO RELATED APPLICATION

This application claims priority to U.S. Provisional Patent Application No. 62/369,573 filed Aug. 1, 2016, the contents of which are incorporated by reference herein.

BACKGROUND OF THE INVENTION

Wallpack (also known as "wall pack") lighting fixtures are known in the prior art. Wallpack lighting fixtures are typically single enclosed housings configured for wall mounting with generally downward light throw. Examples of such designs may be found in U.S. Design Pat. No. D747,533, U.S. Design Pat. No. D691,320 and U.S. Design Pat. No. D653,377.

Typically, wallpack designs are not provided with configurability. In addition, a typical wallpack design requires the use of two installers, particularly during wiring; one installer to support a portion of the housing and the second installer to complete the necessary electrical connections.

SUMMARY OF THE INVENTION

In a first aspect, a wallpack lighting fixture is provided herein for use with solid state lighting and which is configurable to selectively utilize different quantities, up to a maximum, of solid state lighting modules, allowing for different levels and patterns of light output.

In a second aspect, a wallpack lighting fixture is provided herein for use with solid state lighting which includes a main housing and a secondary enclosure removably mountable to the main housing. The secondary enclosure includes an interior sized to accommodate at least one battery pack. This allows for optional use of a back-up battery with a wallpack lighting fixture with all associated heat output being located exteriorly of the main housing of the wallpack lighting fixture.

In a further aspect, a wallpack lighting fixture is provided herein for use with solid state lighting which includes a housing having a wall mountable back panel and a door portion hingeably, and detachably, connected to the back panel. At least one solid state lighting module is located within the door portion. With this arrangement, for installation, the back panel may be removed from the door portion and mounted to a desired location. Thereafter, the door portion may be connected to the back panel. This allows for one-person installation with the weight of the fixture being self-supporting—the one installer may complete the necessary electrical connections without supporting the weight of the fixture. Once the electrical connections are completed, the door portion, relying on the hinged connection, may be swung into a closed state relative to the back panel. Preferably, at least one retaining arrangement may be provided to retain the door portion in a closed state relative to the back panel.

As appreciated by those skilled in the art, the various aspects and features discussed herein may be used singularly or in any combination.

These and other features of the invention will be better understood through a study of the following detailed description and accompanying drawings.

DESCRIPTION OF THE INVENTION

Figure 1:
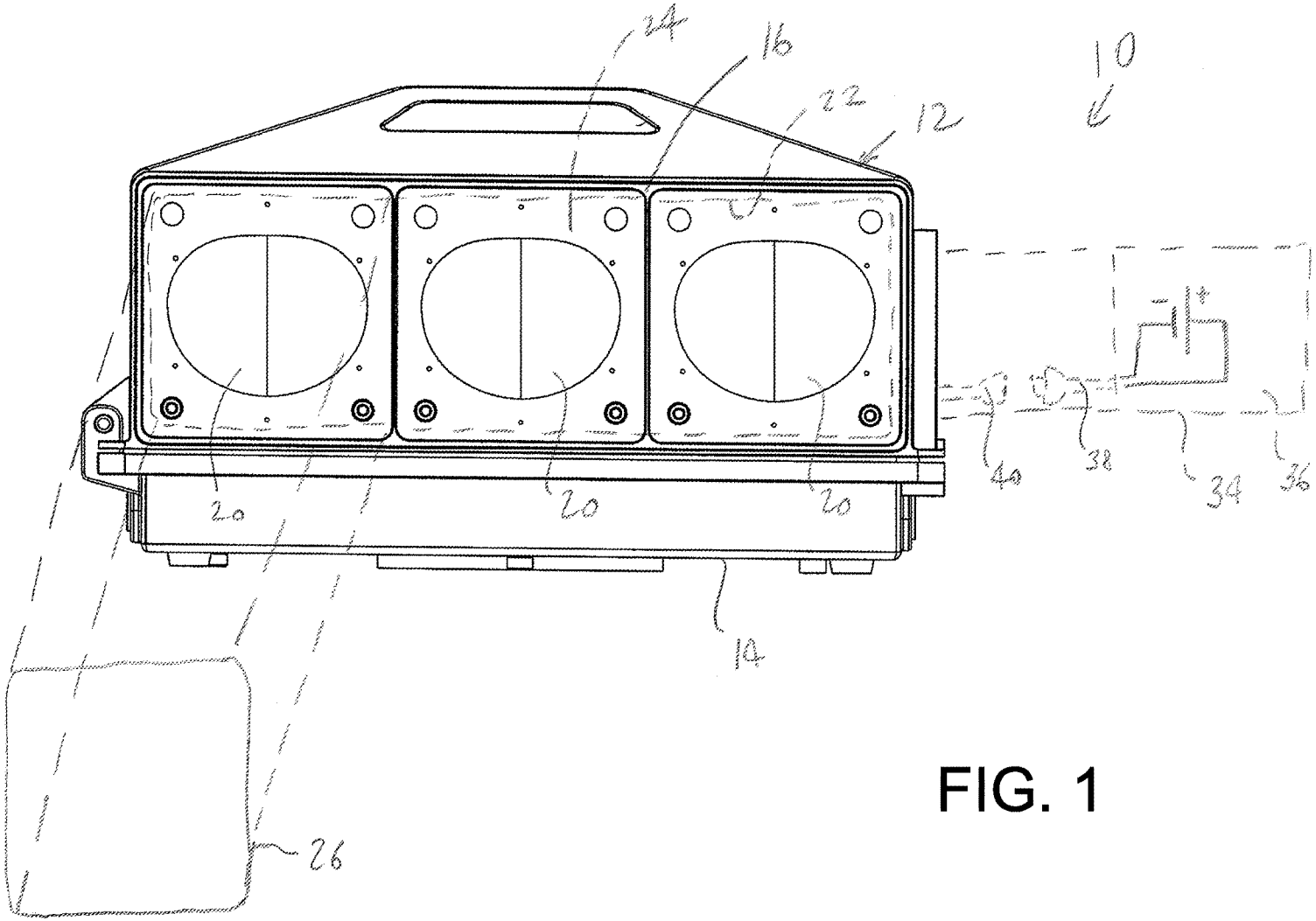
FIG. 1 shows a wallpack lighting fixture in accordance with the subject invention.
Figure 2:
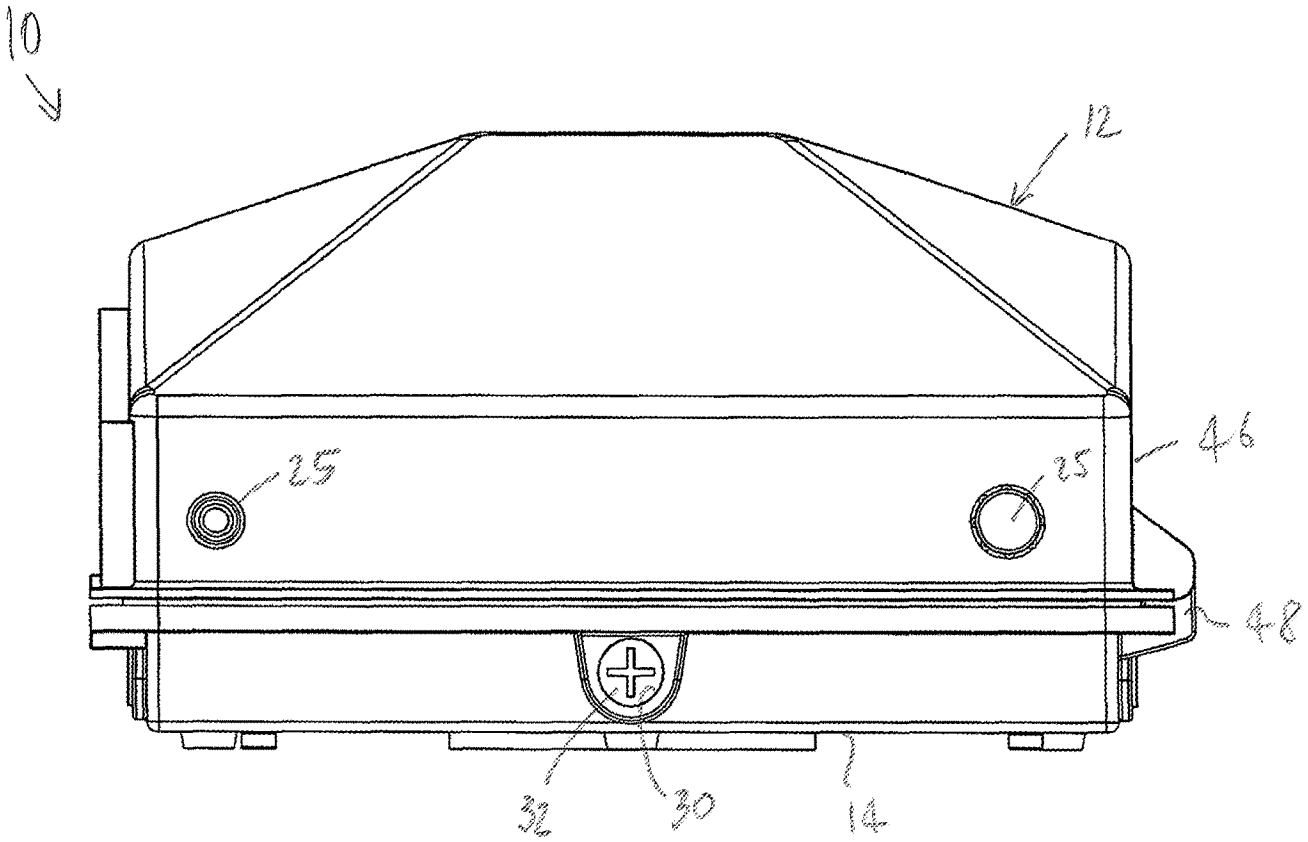
FIGS. 2-7 show different views of the wallpack lighting fixture of FIG. 1.
Figure 3:
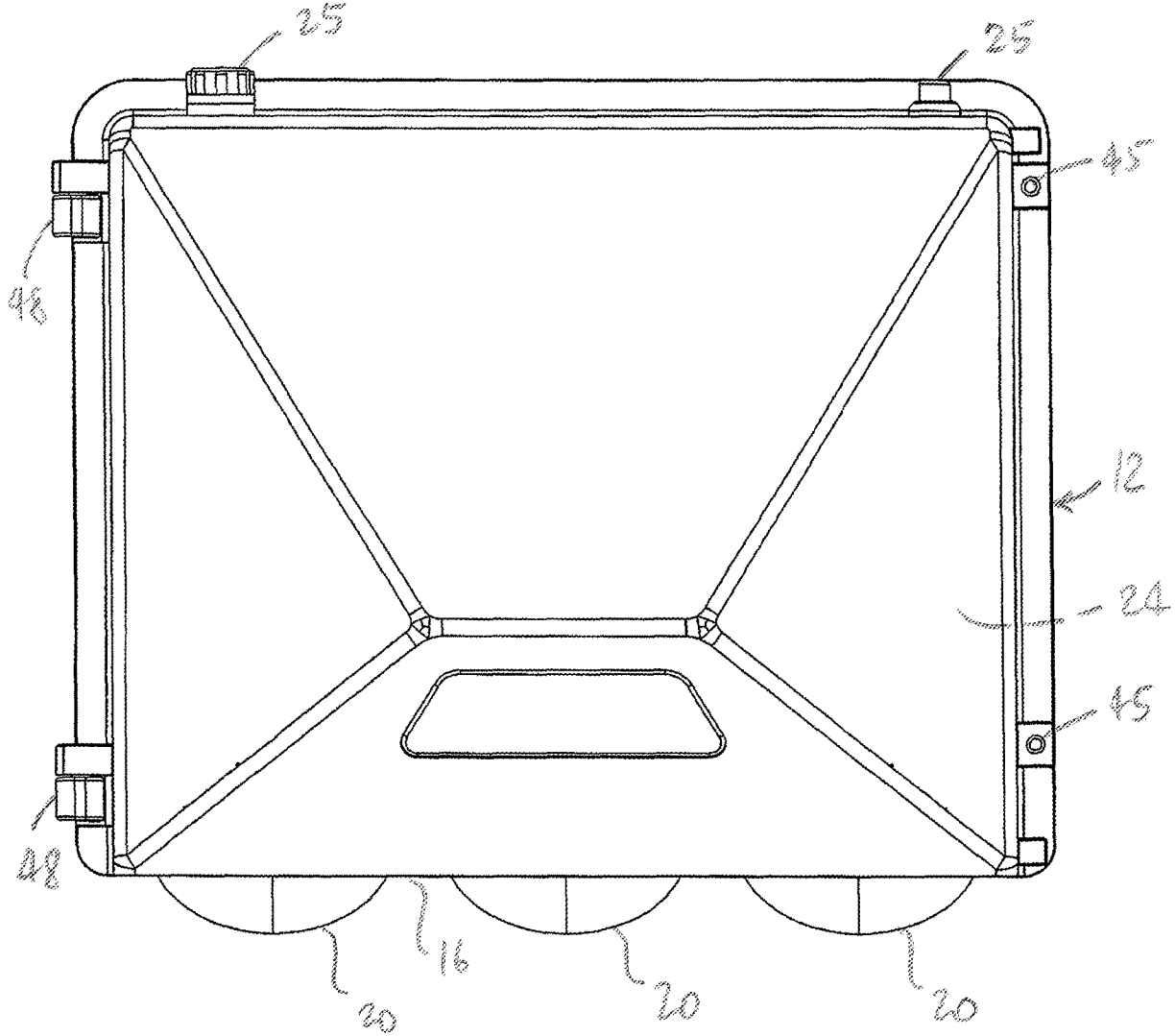
Figure 4:
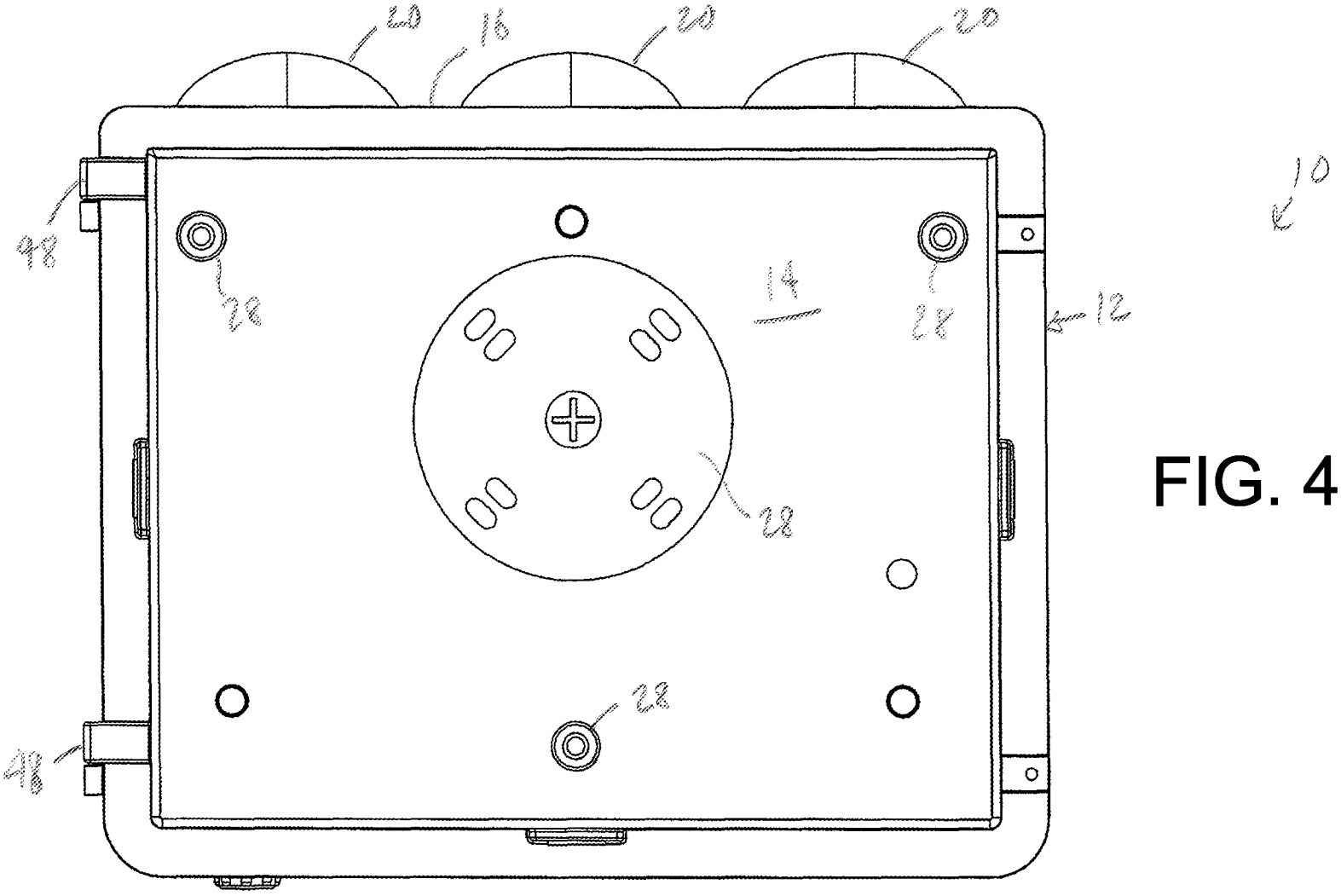
Figure 5:
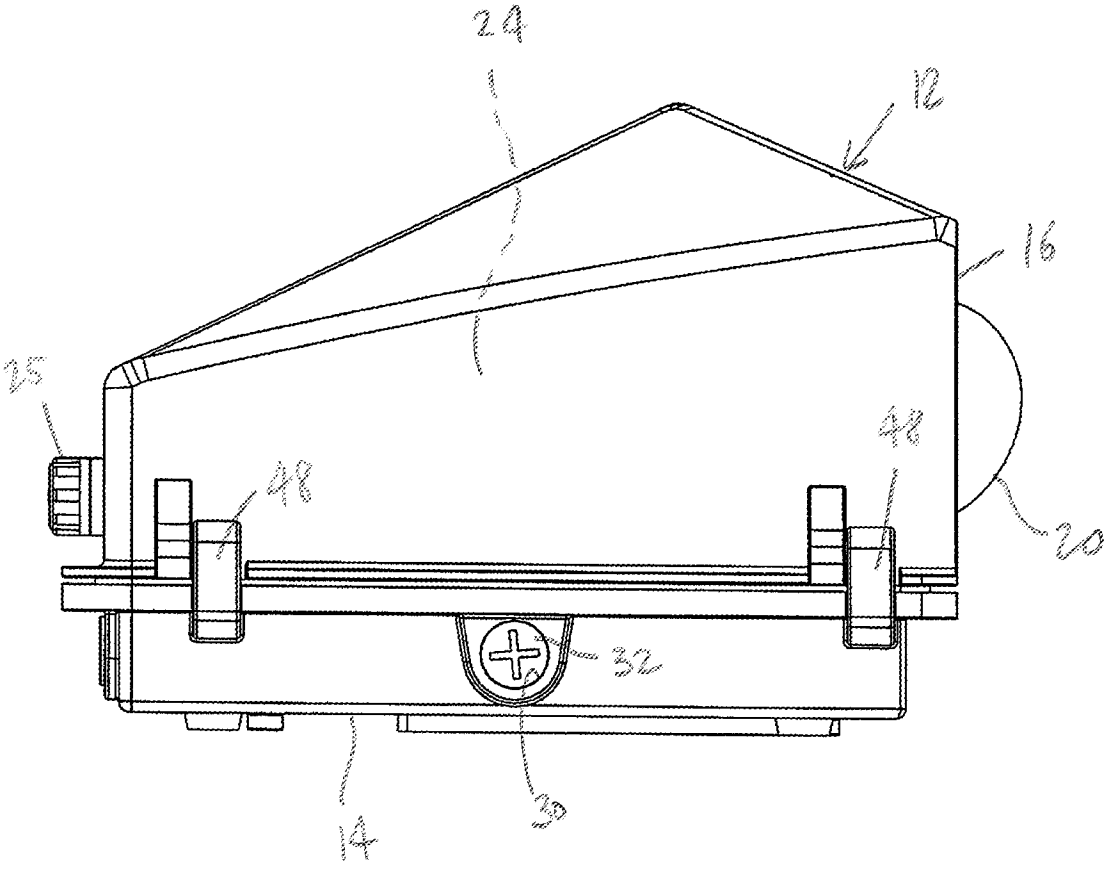
Figure 6:
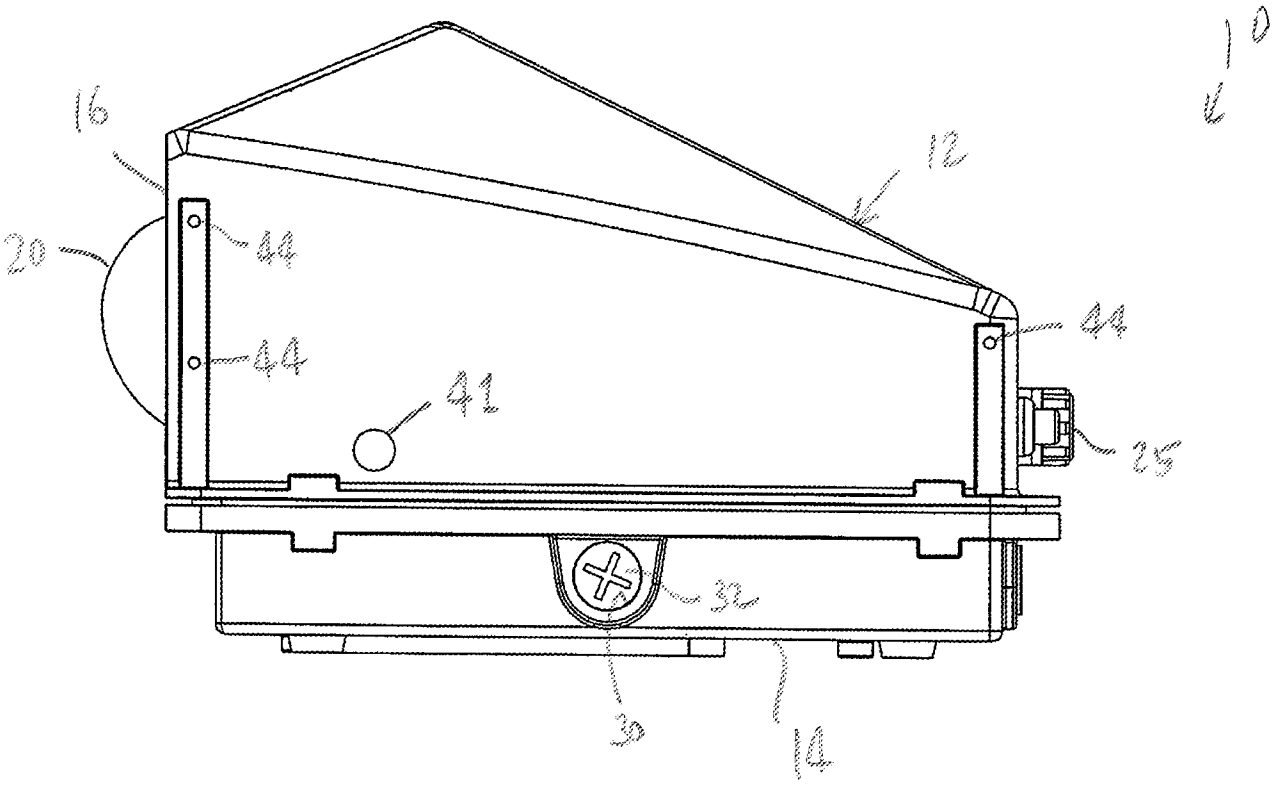
Figure 7:
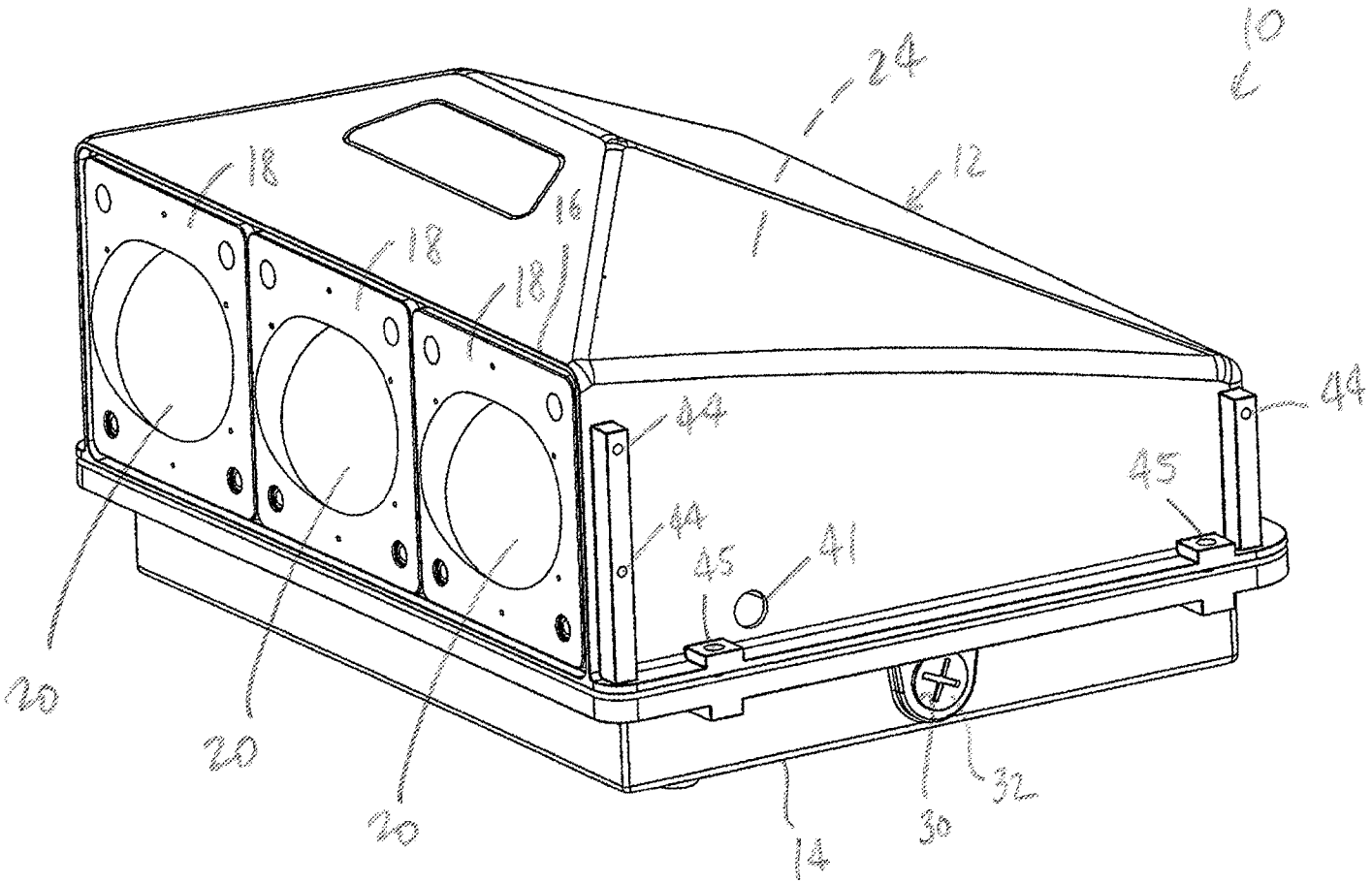
Figure 8:
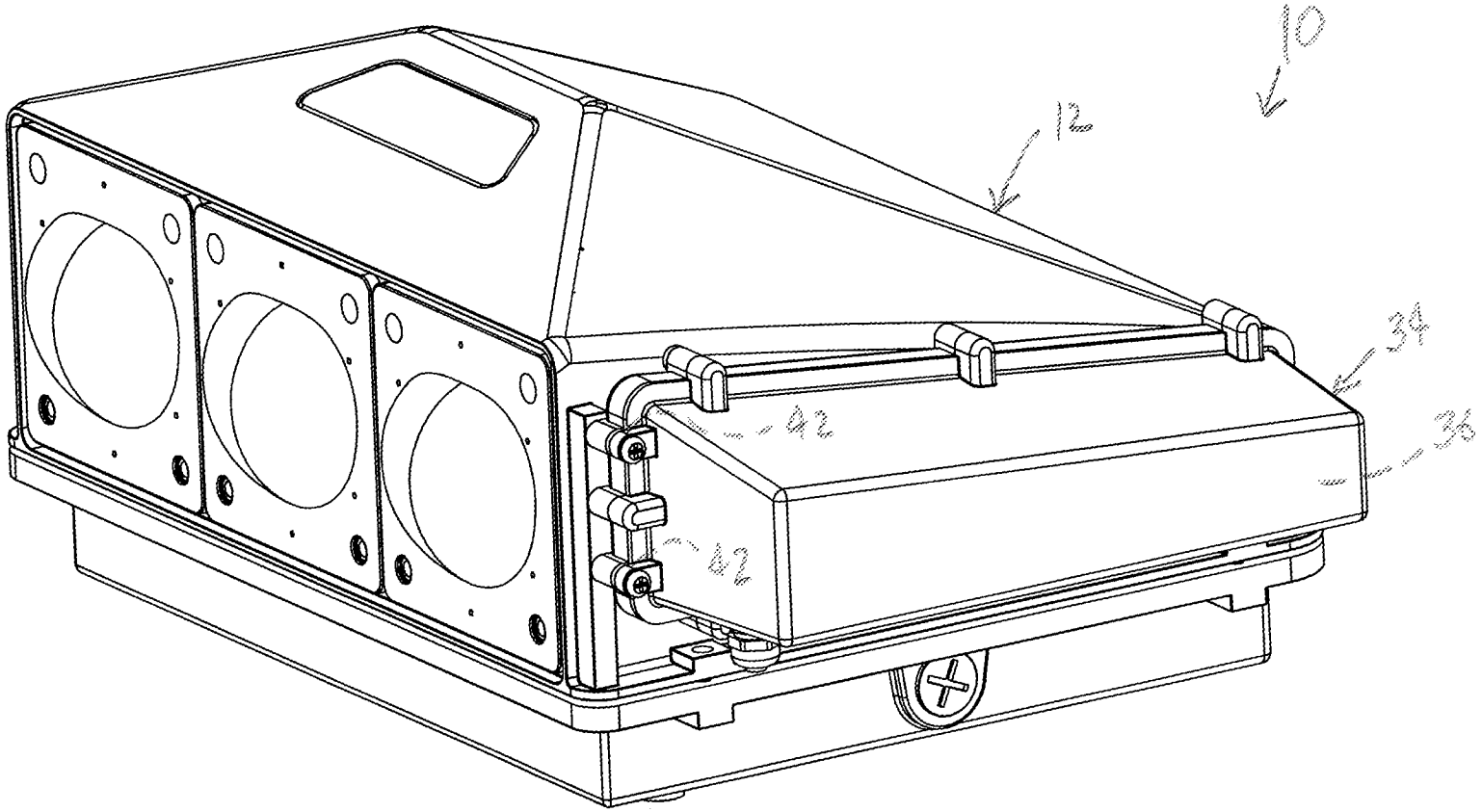
FIG. 8 shows a wallpack lighting fixture with a secondary enclosure in accordance with the subject invention.

With reference to the Figures, a wallpack lighting fixture is shown and generally designated with the reference numeral 10. The wallpack lighting fixture 10 includes a housing 12 with a back panel 14, for mounting to a surface, and a bottom panel 16, for supporting light generating elements. The wallpack lighting fixture 10 is well-suited for wall-mounting applications with generally downward light throw.

One or more solid state light generating modules 18 may be utilized with the wallpack lighting fixture 10 to generate light. As will be appreciated by those skilled in the art, any solid state light generating arrangements and elements may be utilized, including but not limited to, those in LED (light emitting diode), OLED (organic light emitting diode) and/or PLED (polymeric light emitting diode) form. The solid state light generating modules 18 may be each provided as an integrated circuit with a board (such a PCB (printed circuit board)) to which are mounted electrically coupled solid state light generating elements, such as LEDs, OLEDs, and/or PLEDs, in any known manner. The solid state light generating modules 18 may be each separately lensed with a lens 20. The lens 20 may be configured to affect the distribution of generated light, such as by causing a defined pattern, focusing or diffusing. The lens 20 may be of various materials, including glass and/or polymeric material.

The housing 12 may be formed with at least one opening 22 in the bottom panel 16 configured to accommodate a plurality of the solid state light generating modules 18 being mounted thereover. The opening 22 provides access for the solid state light generating modules 18 into an interior 24 of the housing 12. In this manner, electronic components, including electrical power components, such as one or more drivers configured to convert alternating current into direct current, may be accommodated within the interior 24 and accessed by the solid state light generating modules 18. Various control components likewise may be accommodated within the housing 12, including the interior 24, for controlling different aspects of the solid state light generating modules 18 such as actuation by motion sensors and/or daylight sensors. The sensors may have detectors (motion, daylight) located externally of the housing 12 or exposed by portions of the housing 12. One or more drill outs 25 may be provided in the housing 12 to accommodate the detectors (with exposure thereof).

The solid state light generating modules 18 may be electrically coupled with any components within the interior 24 via the opening 22 using any known connections. Optionally, or additionally, the driver(s) and/or other electrical components may be provided with the solid state light generating modules 18.

Preferably, the solid state light generating modules 18 are sized so as to allow for a plurality to be used with the wallpack lighting fixture 10. This allows for different configurations of light generation, both in intensity and pattern. The solid state lighting generating modules 18 may be similarly prepared (e.g., same light output, same lenses) or differently prepared (e.g., different light output and/or different lenses) to allow for scalability and/or mixing and matching. If less than a permissible maximum quantity of the solid state light generating modules 18 is utilized, one or more cover plates 26 may be utilized to cover exposed (non-used) portions of the opening 22. FIG. 1 shows schematically the interchangeability of at least one of the solid state light generating modules 18 and the cover plate 26. Various combinations may be used. Preferably, the solid state light generating module(s) 18 and the cover plate(s) 26 collectively cover the opening 22 with the wallpack lighting fixture 10 in use.

The housing 12 may be provided with one or more knockouts 28 to allow for ingress of one or more wires. One or more of the knockouts 28 may be located in the back panel 14, e.g., to accept external power supply wires (including grounding wire(s)). Also, one or more conduit access holes 30 may be provided to allow for junctions with tubing or piping conveying electrical wiring. The access holes 30 may be provided with removable plugs 32 to cover the access holes 30 when not in use. The access holes 30 may be internally threaded to threadedly engage the tubing or piping. Standard NPS (nominal pipe sizes) may be accommodated. Tubing or piping enclosed wiring may allow for a plurality of the wallpack lighting fixtures 10 be powered in series and/or in parallel by a common power source.

Optionally, a secondary enclosure 34 may be utilized with the wallpack lighting fixture 10 configured to have an interior 36 sized to accommodate at least one battery pack. The enclosure 34 is preferably completely enclosed to restrict ingress of moisture into the interior 36. The enclosure 34 preferably includes at least one external electrical connector 38 for electrically coupling with the housing 12 so that electrical power from the accommodated battery pack(s) may be utilized to power, at least in part, the solid state light generating modules 18. A connector 40 may be provided with the housing 12 formed to electrically couple with the electrical connector 38, as shown schematically in FIG. 1. The connector 40 may be in any known form, such as a port, jack, mateable connection element, etc. provided through a connector opening 41. With the use of the electrical connector 38 and the connector 40, an electrical connection may be established between the housing 12 and the enclosure 34 with both being fully enclosed. Also, this allows for addition of the enclosure 34 to the wallpack lighting fixture 10 after installation. All known manners of electrically coupling the electrical connector 38 with any accommodated battery pack(s) and of electrically coupling the connector 40 with the electrical components within the housing 12 to allow for proper supply and distribution of power for the battery pack(s) to the solid state light generating modules 18 may be utilized. This includes any by-passing of components as needed, as well as, the inclusion of triggers, such as magnetic relays, which reactively detect the need for back-up power. A back-up battery test button may be provided on the housing 12 or the enclosure 34 which is externally accessible to be actuated to test available back-up power. The test button may be accommodated by one of the drill outs 25 or the knockouts 28.

Any form of mounting arrangement may be utilized to mount the enclosure 34 to the housing 12. Preferably, the mounting is reversible, such as with screw mounting. The enclosure 34 may be provided with screw mounting holes 42 positioned to be in registration with threaded bores 44 in the housing 12. Other mounting arrangements may be utilized such as friction fits, interference fits and cooperating mechanical arrangements (bayonet locks, detents, ribs, grooves, etc.).

Preferably, the enclosure 34 is configured to mount to external portions of the housing 12. In this manner, heat generated within the enclosure 34 may be best dissipated. Increased heat dissipation typically results in prolongation of battery life. The external locating of the enclosure 34 on the housing 12 may provide a benefit to the useful life of any battery accommodated in the enclosure 34.

Further, the housing 12 may be provided as two basic components, the back panel 14 and a door portion 46. Preferably, the door portion 46 is hingedly connected to the back panel 14 with a hinge connection 48. The hinge connection 48 may be in one or more sections and may be of any known form, including a pinned hinge, living hinge, etc. Moreover, preferably, the door portion 46 is detachable from the back panel 14. In this manner, the back panel 14 may be separated from the door portion 46 for installation. With the back panel 14 being mounted to a target surface, the door portion 46 may be connected to the back panel 14 so as to be supported thereby. With the door portion 46 being supported by the back panel 14 via the hinge connection 48, the wallpack lighting fixture 10 may be installed by one installer. With the weight of the door portion 46 supported by the back panel 14, one installer may be able to prepare all necessary electrical connections. Thereafter, utilizing the hinged connection 48, the door portion 46 may be urged to a closed portion with the back panel 14. By way of non-limiting example, screw holes 45 may be provided in the back panel 14 and/or the door portion 46 for accepting screws to retainingly fasten the door portion 46 to the back panel 14. Preferably, a latch on other retaining arrangement may be provided to retain the door portion 46 in a closed state relative to the back panel 14. Preferably, a seal or gasket is provided to create a liquid-tight seal about the junction between the back panel 14 and the door portion 46.

As will be appreciated by those skilled in the art, the components of the housing 12 may be distributed between the back panel 14 and the door portion 46 in various combinations. For example, the solid state light generating modules 18 may be fixed to the door portion 46. Power supply wires may be pulled through the back panel 14, such as through any of the knockouts 28 and the access holes 30 with electrical connections being made as needed. Advantageously, the use of the door portion 46 allows for one-person installation.

What is claimed is:

1. A configurable solid state wallpack lighting fixture comprising:

a housing;

an opening in a lower panel of said housing;

at least one solid state lighting module mountable over said opening; and, at least one driver within said housing for electrically coupling with, and providing electrical power to, through said opening, said at least one solid state lighting module, wherein, said opening being configured to accommodate a plurality of said solid state lighting modules being mounted thereover including a maximum quantity of said solid state lighting modules, wherein, with a quantity of solid state lighting modules less than said maximum quantity, at least one cover plate is provided to overlay said opening adjacent to, and in direct contiguous contact with at least one of said solid state lighting modules mounted over said opening so that collectively said quantity of solid state lighting modules and said at least one cover plate completely cover said opening, wherein a plurality of said solid state lighting modules is provided, each having the same light output, and wherein said at least one cover plate is interchangeable with one of said solid state lighting modules in overlaying said opening.

2. A configurable solid state wallpack lighting fixture as in claim 1, wherein each of said solid state lighting modules having a same-formed lens.

3. A configurable solid state wallpack lighting fixture as in claim 1, wherein a plurality of said solid state lighting modules is provided, each having a same-formed lens.

4. A configurable solid state wallpack lighting fixture as in claim 1, further comprising:

an enclosure removably mountable to said housing, said enclosure including an interior sized to accommodate at least one battery pack, wherein, said enclosure is completely enclosed so as to restrict ingress of moisture into said interior, said enclosure including at least one external electrical connector for electrically coupling with said housing so that electrical power from said at least one battery pack may be utilized to power said at least one solid state lighting module.

5. A configurable solid state wallpack lighting fixture as in claim 4, further comprising a connector electrically coupled to the housing to allow for electrical connection to the driver, the connector being electrically couplable to the external electrical connector.

* * * * *